United States Patent [19]

Monta

[11] 4,250,946

[45] Feb. 17, 1981

[54] METHOD FOR PRODUCING INGOT MOLD STOOLS

[75] Inventor: Louis A. Monta, Monroeville, Pa.

[73] Assignee: United States Steel Corporation, Pittsburgh, Pa.

[21] Appl. No.: 57,044

[22] Filed: Jul. 12, 1979

Related U.S. Application Data

[63] Continuation-in-part of Ser. No. 883,028, Mar. 3, 1978, abandoned.

[51] Int. Cl.[3] ..... B22C 1/00

[52] U.S. Cl. ..... 164/137; 164/138; 164/363

[58] Field of Search ..... 164/33, 137, 138, 339, 164/363, 122; 249/111, 112, 174, 204, 109

[56] References Cited

U.S. PATENT DOCUMENTS 3,438,424 4/1969 North ..... 164/138

*Primary Examiner*—Robert D. Baldwin
*Assistant Examiner*—K. Y. Lin
*Attorney, Agent, or Firm*—Forest C. Sexton

[57] ABSTRACT

Cast iron ingot mold stools having exceptionally smooth flat surfaces and a longer average life are produced by casting such stools in a mold, the inside of which is formed by rigid thermal insulative boards.

5 Claims, 3 Drawing Figures

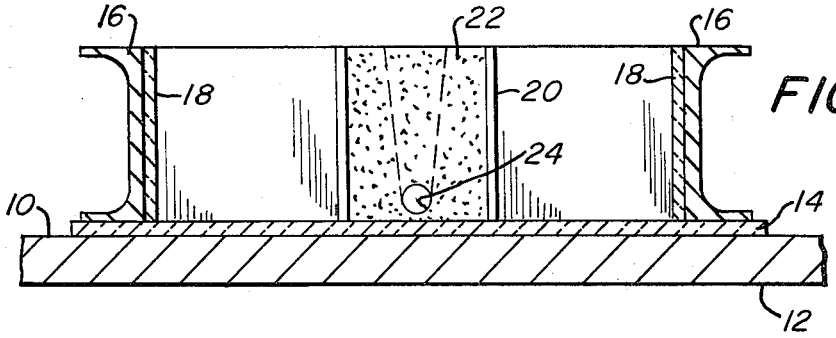
FIG. 1
FIG. 2
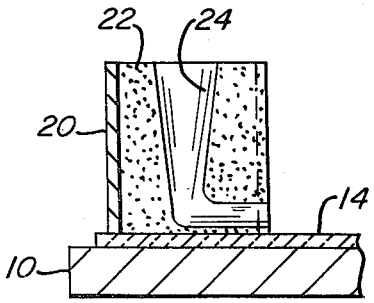
FIG. 3
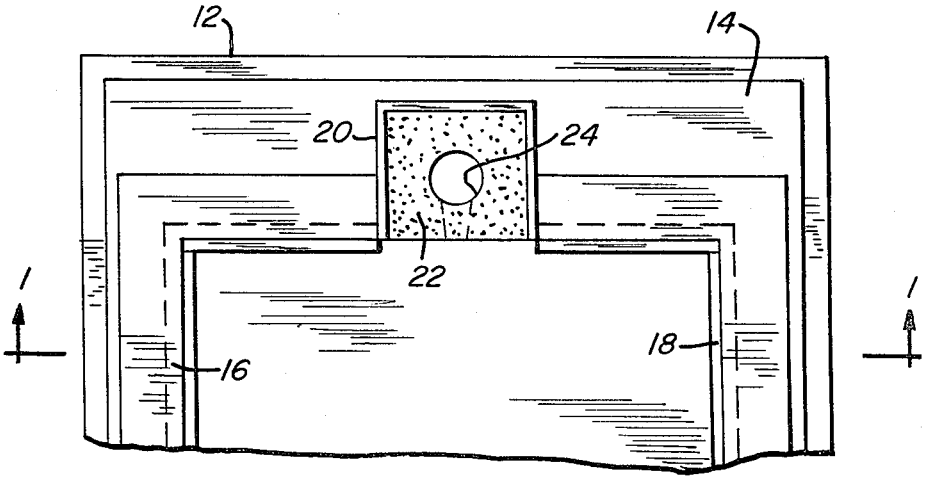

METHOD FOR PRODUCING INGOT MOLD STOOLS

CROSS-REFERENCE TO RELATED APPLICATION

This is a continuation-in-part application of application Ser. No. 883,028, filed Mar. 3, 1978, now abandoned.

BACKGROUND OF THE INVENTION

Ingot molds used in the production of steel ingots usually consist of upright cast iron, box-like shells open at both ends. To close the bottom for casting steel therein, the mold is placed upright on a thick cast iron mold stool. Hence, an ingot mold cavity is formed by the mold stool on the bottom and the interior side-walls of the ingot mold thereover. A reasonably close fit between the mold and stool should be assured to prevent leakage of molten steel therebetween.

Ingot molds and mold stools are usually manufactured in accordance with established sand-mold foundry techniques. While molding techniques for the manufacture of ingot molds has undergone some refinements, such as chill casting procedures, mold stools are still usually produced by conventional age-old foundry practices. Specifically, a rectangular molding flask is placed over and clamped to a rigid molding plate to form an open-topped box-like structure. Molding sand is then spread over the inside bottom to a depth of several inches, and then compacted to form a flat sand surface. A rectangular pattern, usually made of wood, is then placed on the flat sand surface such that there is several inches of clearance between the sides of the pattern and the flask walls. Molding sand is then compacted into that space. The pattern is then carefully removed to leave a rectangular cavity in the molding sand. A pouring gate must also be provided in the molding sand adjacent to the cavity to funnel molten cast iron to the bottom of the cavity. After the mold stool has been cast in the cavity and solidified, the cast metal is removed from the sand mold, the gate broken-off and the surfaces cleaned. Surface cleaning is usually performed by hand, using a pneumatic chipper to scrape-off the molding sand adhering to the as-cast surface.

SUMMARY OF THE INVENTION

This invention is predicated upon my development of a new and improved method for producing ingot mold stools which utilizes thermal insulative boards instead of molding sand to shape the mold, thereby greatly simplifies the mold-making procedure, the casting conditions and surface cleaning; and which produces a superior casting having smoother and flatter surfaces and a longer service-life span; and finally provides a healthier foundry environment by eliminating dust and dirt conditions associated with conventional sand casting.

BRIEF DESCRIPTION OF THE DRAWINGS

FIG. 1 is a cross-sectional side view of the mold used to cast an ingot mold stool according to this invention.

FIG. 2 is a cross-sectional side view of the gate as shown in FIG. 1.

FIG. 3 is a partial top view of the mold illustrating the gate shown in FIGS. 1 and 2.

DESCRIPTION OF THE PREFERRED EMBODIMENT

With reference to FIG. 1, the ingot mold stool of this invention is formed by first providing a smooth flat surface 10 upon which the rest of the mold is constructed. For example, a thick metallic plate 12 of suitable dimensions may be laid flat on a horizontal heat resistant surface such as the foundry floor. Thereafter, a rectangular thermal insulative board 14 is placed on top of surface 10. A rectangular molding flask 16 is then placed on top of insulative board 14. Insulative board 14 should be suitably sized so that it extends at least to the outer perimeter of molding flask 16 so that the weight of flask 16 will readily hold insulative board 14 in place and provide as much of a seal therebetween as possible. Four thermal insulative boards 18 (only two are shown) are then secured to the inside surfaces of molding flask 16. Although any suitable means may be used to secure insulative boards 18 to the inside face of flask 16, I have preferred to use a commercially available nailing system wherein a nail is driven through the molding board 18 and into the molding flask 16 to hold the insulative boards 18 in place.

Although it is possible to cast the molten iron directly into the open-topped mold as shown in FIG. 1, I have preferred to provide a gate, as shown in FIG. 2, so that the smooth flat surface of the insulative board 14 is not disturbed or damaged by the pour stream. The gate is formed by providing a small rectangular extension 20 on one wall of flask 16 (FIG. 3) sufficient to receive a preshaped and baked sand gate 22 having a pouring gate 24 therethrough.

In a preferred practice of this invention, I have found it most helpful to place an insulative cover over molding flask 16 before the metal is cast. Normally, I have used an 8-inch cast iron plate, which serves three very useful functions: one, the added weight on flask 16 serves to better seal the interface between insulative board 14 and flask 16; two, the heavy plate further thermally insulates the casting to slow the cooling rate as necessary to effect the desired microstructure; and three, the plate will shield the foundry workers from radiant heat. As an alternative, a loose particulate insulative material, such as vermiculite, has been used by spreading it over the cast metal. While this alternative insulates the casting and shields the workers from radiant heat, it does not provide added weight to better seal the mold.

When the mold is completed as shown in the drawings, molten iron is cast into gate 28 filling the mold cavity defined by insulative boards 14 and 18, and the molten metal therein is allowed to solidify, When solidified, the casting is removed and the gate metal broken-off. The resulting casting, i.e. those surfaces formed against insulative boards 14 and 8 are exceptionally smooth and flat. Since no sand was used to form any of the stool surfaces, no chipping or surface conditioning is necessary. All that may be necessary is that portions of the insulative boards may have to be scraped-off.

In the above-described process, it is essential that insulative boards 14 and 18 have good thermal-insulative properties so that the stool casting will cool and solidify slowly, at least as slow as in conventional sand molds, and preferably even more slowly. Such slow cooling rates will promote a microstructure having large graphite flakes, which serve to enhance the stools' life span as discussed below. To this end, I have utilized rigid boards ¼-inch thick consisting of compressed fibrous silica-alumina which are commercially available from Norman F. Tisdale & Associates, Inc., Gibsonia, Pennsylvania. Such boards have a density of 24 pounds per cubic foot and have excellent thermal-insulative properties. In combination with the good thermal insulative characteristics of boards 14 and 18, the thick metal plate 12, the foundry floor upon which plate 12 rests and the optional cover, further serve to insulate the casting to promote slow cooling.

The procedure as described above not only eliminated the use of molding sand (except for the optional gate) but it also significantly reduces the manpower necessary to produce the mold and to condition the casting, and it also produces a cast stool of greatly improved quality. The quality improvements are not only physical in that the surfaces are smoother and flatter as compared to stools produced in sand molds, but also such stools have been shown to have a longer average life. For example, the first mold stool produced according to the above-described embodiment was used in excess of 100 pours, whereas prior art stools are scrapped after about 50 pours on an average. After the above-described practice was established as the standard practice for producing mold stools in one foundry, the stool condemnation rate dropped over a period of eight months from 18 lbs/ton to 14 lbs/ton. The condemnation rate is the pounds of stool scrapped per ton of steel poured thereon. The improved rate of 14 lbs/ton noted above does not fully reflect the advantages of this invention as it is the rate of all stool on hand including those produced pursuant to prior art practices. Hence, the improved rate of from 18 lbs/tons to 14 lbs/ton reflects a gradual improvement in condemnation rate as the stools produced by this inventive method gradually increase in number and in proportion to the prior art stools.

As noted above, this inventive process provides the added advantage of providing a healthier foundry environment. While this advantage has been appreciated since the first actual reduction to practice, its significance has become even more important in more recent months. Specifically, new OSHA standards have set maximum limits on silica contents in foundry atmospheres in order to minimize the risk of silicosis to foundry workers. Some steel mill foundries which produce only ingot mold stools have been threatened with a complete close-down due to their inability to meet these new standards. In utilizing this inventive process, however, at least one such foundry to date has been able to easily meet the new silica standards to stay in operation and also reap the other advantages produced by this process.

I claim:

1. A method for producing ingot mold stools having smooth flat as cast surfaces and characterized by a microstructure as cast which will provide a longer useful life than stools produced in conventional sand molds; the steps comprising, placing a first flat thermal-insulative board of compressed fibrous silica-alumina onto a flat, horizontal, heat resistant surface, placing a rigid molding flask over said first insulative board such that the molding flask holds said first insulative board in place and provides a peripheral seal at the interface, lining the inside surfaces of said molding flask with vertically disposed thermal-insulative boards of compressed fibrous silica-alumina, casting molten iron into the cavity defined by the first horizontal thermal-insulative board and the vertical thermal-insulative boards thereover, allowing said cast iron to cool and solidify slowly due to the thermal-insulative nature of the cavity and removing the iron casting from the thermal-insulative board mold.

2. A method according to claim 1 in which said molding flask is provided with an extended wall portion sufficient to receive a preformed sand gate and casting said molten iron through said gate.

3. A method according to claim 1 in which said flat, horizontal heat resistant surface is a heavy metallic plate.

4. A method according to claim 1 in which thermal-insulative material is placed on top of the molding flask to further promote slow cooling of the cast iron.

5. A method according to claim 4 in which said thermal-insulative material is a heavy metallic plate.

* * * * *